US008181719B2

(12) United States Patent
Bunney et al.

(10) Patent No.: US 8,181,719 B2
(45) Date of Patent: May 22, 2012

(54) FLOW PULSING DEVICE FOR A DRILLING MOTOR

(76) Inventors: Larry Raymond Bunney, Tofield (CA); Trevor Nicholas Stanley Lisowski, Edmonton (CA)

( * ) Notice: Subject to any disclaimer, the term of this patent is extended or adjusted under 35 U.S.C. 154(b) by 269 days.

(21) Appl. No.: 12/570,172

(22) Filed: Sep. 30, 2009

(65) Prior Publication Data

US 2011/0073374 A1 Mar. 31, 2011

(51) Int. Cl.
*E21B 4/02* (2006.01)

(52) U.S. Cl. ..... 175/56; 175/107; 175/232

(58) Field of Classification Search ..... 175/56, 175/107, 231, 232
See application file for complete search history.

(56) References Cited

U.S. PATENT DOCUMENTS 2,743,083 A 4/1956 Zublin
4,819,745 A 4/1989 Walter
4,830,122 A * 5/1989 Walter ..... 175/106
6,279,670 B1 8/2001 Eddison et al.
6,289,998 B1 * 9/2001 Krueger et al. ..... 175/25
2001/0054515 A1 * 12/2001 Eddison et al. ..... 175/56
2005/0178558 A1 * 8/2005 Kolle et al. ..... 166/373

* cited by examiner

*Primary Examiner* — William P Neuder
(74) *Attorney, Agent, or Firm* — Ryan W. Dupuis; Kyle R. Satterthwaite; Ade & Company Inc.

(57) ABSTRACT

A downhole flow pulsing device comprises a housing connected in series with a drill string and a valve with a rotating portion in the housing arranged to vary an area of a flow passage through the housing. A fluid actuated positive displacement motor drives rotation of the valve. A drive link permits the rotating portion of the valve to be optionally coupled directly to the motor of the drill string. The valve includes radially oriented rotating ports intermittently communicating with surrounding fixed ports and a bypass channel. Axial displacement of the rotating ports relative to the fixed ports and bypass channel permits amplitude of the downstream fluid pulses to be adjusted. The valve includes a number of circumferentially spaced ports which differs from a prescribed number of pressure fluctuations in the fluid for each full rotation of the rotor of the drill motor.

18 Claims, 3 Drawing Sheets

FLOW PULSING DEVICE FOR A DRILLING MOTOR

FIELD OF THE INVENTION

The present invention relates to a flow pulsing device arranged to pulse drilling fluid of a drilling motor in a drilling string.

BACKGROUND

When drilling an oil or gas production well using a drill string, it is common to encounter static friction that limits advancement of the drill string into the bore being formed. In these instances it is known to be desirable to pulse the flow of drilling fluid pumped through the drill string to vibrate the drill and reduce the static friction so that deeper wells can be more readily produced. Examples of prior United States Patents relating to pulsing the flow of drilling fluid include U.S. Pat. No. 6,279,670 by Eddison et al; U.S. Pat. No. 4,819,745 by Walter; and U.S. Pat. No. 2,743,083 by Zublin.

In Zublin, U.S. Pat. No. 2,743,083, various embodiments are disclosed in which a rotating valve component is driven to rotate by suitable vanes coupled thereto or by the orientation of the flow passages therethrough. As the rotating valve component is directly driven by vanes coupled thereto, the amount of pulse capable is limited. Furthermore in some embodiments a bypass area is provided, however the bypass area is proportionally very large compared to the pulsing component so as to further limit the amount of pulsing possible.

Walter, U.S. Pat. No. 4,819,745, discloses a further example of a flow pulsing device in which the rotating component of the valve creating the pulses is driven by an impeller with vanes integrally associated therewith so that the overall structure of the integrated valve and impeller is very complex and can therefore have problems with reliability. The direct coupling of the impeller with the rotating valve component may also limit the amount of pulsing possible.

Eddison, U.S. Pat. No. 6,279,670, discloses another example of a flow pulsing apparatus in which a dedicated motor comprising a rotator rotating within a stator is required to be provided separate from the drilling motor just for driving the valve component. The overall assembly of a flow pulsing valve together with a motor operated solely for rotating the valve is a costly and complex structure to be installed in a drill string separate from the drilling motor.

SUMMARY OF THE INVENTION

According to one aspect of the invention there is provided a downhole flow pulsing device for use with a drill string comprising a tubing string, a drilling motor having a stator housing connected in series with the tubing string and a rotor supported in the stator housing so as to be arranged to rotate relative to the stator housing and tubing string responsive to a flow of pressurized drilling fluid into the tubing string, and a drill bit coupled to a bottom end of the rotor of the drilling motor so as to be arranged to rotate with the rotor of the drilling motor, the downhole flow pulsing device comprising:

a tubular housing arranged to be connected in series with the tubing string, the housing having an axial bore extending along a longitudinal axis therethrough so as to be arranged to permit passage of the drilling fluid therethrough;

a valve supported in the bore of the tubular housing and defining a flow passage arranged to receive the drilling fluid therethrough, the valve comprising a fixed portion in fixed relation to the tubular housing and a rotating portion rotatably supported in the tubular housing so as to vary an area of the flow passage as the rotating portion rotates relative to the fixed portion;

a drive link member arranged to be connected between the rotating portion of the valve and the rotor of the drilling motor so as to rotate the rotating portion of the valve relative to the tubing string together with the rotor of the drilling motor.

By providing a valve with a drive link member connected thereto which permits connection of the valve directly to the drilling motor, the flow pulsing device is simple in construction having a minimum number of components which can be installed at any point in the drill string above the drilling motor. The direct coupling of the flow pulsing valve to the rotor permits the valve to be maintained in a reliable manner out of synchronicity with the natural vibration of the drilling motor to maximize the amplitude of the vibrations produced with a simple reliable structure.

According to a second aspect of the present invention there is provided a downhole flow pulsing device for use with a tubing string arranged to receive a flow of pressurized drilling fluid therethrough, the device comprising:

a tubular housing arranged to be connected in series with the tubing string, the housing having an axial bore extending along a longitudinal axis therethrough so as to be arranged to permit passage of the drilling fluid therethrough;

a valve supported in the bore of the tubular housing and defining a flow passage arranged to receive the drilling fluid therethrough, the valve comprising a fixed portion in fixed relation to the tubular housing and a rotating portion rotatably supported in the tubular housing so as to vary an area of the flow passage as the rotating portion rotates relative to the fixed portion;

a fluid actuated positive displacement motor arranged to drive rotation o the rotating portion of the valve responsive to the flow of pressurized drilling fluid in the tubing string;

the rotating portion of the valve being supported in an axially extending valve bore in the fixed portion so as to be rotatable about the longitudinal axis relative to the fixed portion;

the fixed portion comprising a plurality of fixed ports at circumferentially spaced positions for communication between the valve bore and an annular space in the tubular housing about the drive link member therebelow;

the rotating portion comprising a central bore having a top end arranged to receive drilling fluid from the tubing string and a plurality of rotating ports at circumferentially spaced positions extending radially outward from the central bore so as to be arranged to intermittently communicate with the fixed ports as the rotating portion of the valve is rotated;

the rotating portion being positioned relative to the fixed portion to define a bypass area which remains in communication between the central bore of the rotating portion and the annular space in the tubular housing below the valve as the rotating ports intermittently communicate with the fixed ports; and the bypass area being adjustable by displacing the fixed portion relative to the rotating portion in a direction of the longitudinal axis.

By further providing a fixed valve portion which is adjustable in a longitudinal direction relative to a rotating component of the valve, an amount of fluid which bypasses the valve relative to the intermittent flow passage of the valve allows the amplitude of the vibration to be readily adjusted in the field unlike prior devices.

According to a further aspect of the present invention there is provided a downhole flow pulsing device for use with a tubing string arranged to receive a flow of pressurized drilling fluid therethrough, the device comprising:

a tubular housing arranged to be connected in series with the tubing string, the housing having an axial bore extending along a longitudinal axis therethrough so as to be arranged to permit passage of the drilling fluid therethrough;

a valve supported in the bore of the tubular housing and defining a flow passage arranged to receive the drilling fluid therethrough, the valve comprising a fixed portion in fixed relation to the tubular housing and a rotating portion rotatably supported in the tubular housing so as to vary an area of the flow passage as the rotating portion rotates relative to the fixed portion; and a fluid actuated positive displacement motor comprising a stator housing arranged to be connected in series with the tubing string and a rotor which is rotatable within the stator housing and connected to the rotating portion of the valve so as to be arranged to drive rotation of the rotating portion of the valve responsive to the flow of pressurized drilling fluid in the tubing string;

the motor being arranged to generate a prescribed number of pressure fluctuations in the drilling fluid for each full rotation of the rotor within the stator housing;

wherein the rotating portion of the valve comprises a plurality of rotating ports and the fixed portion comprises a plurality of fixed ports arranged to intermittently communicate with the rotating ports as the rotating portion is rotated relative to the fixed portion;

the number of rotating ports and said prescribed number being different from one another.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
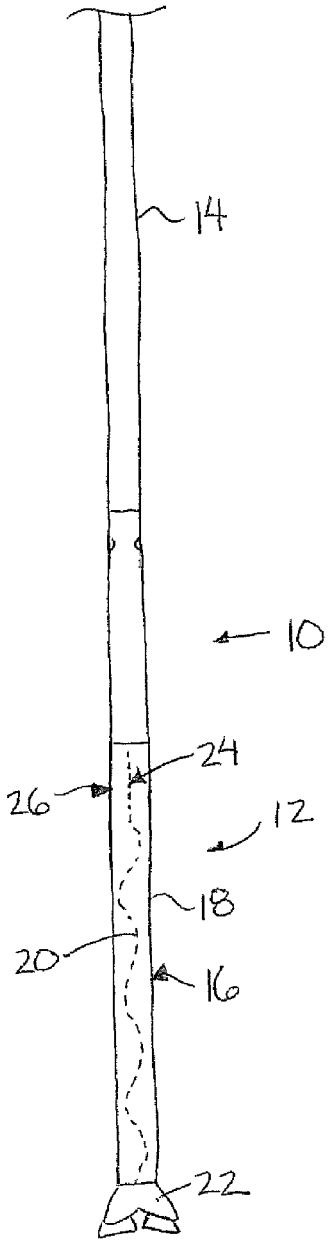
FIG. 1 is a schematic representation of a drill string.
Figure 2:
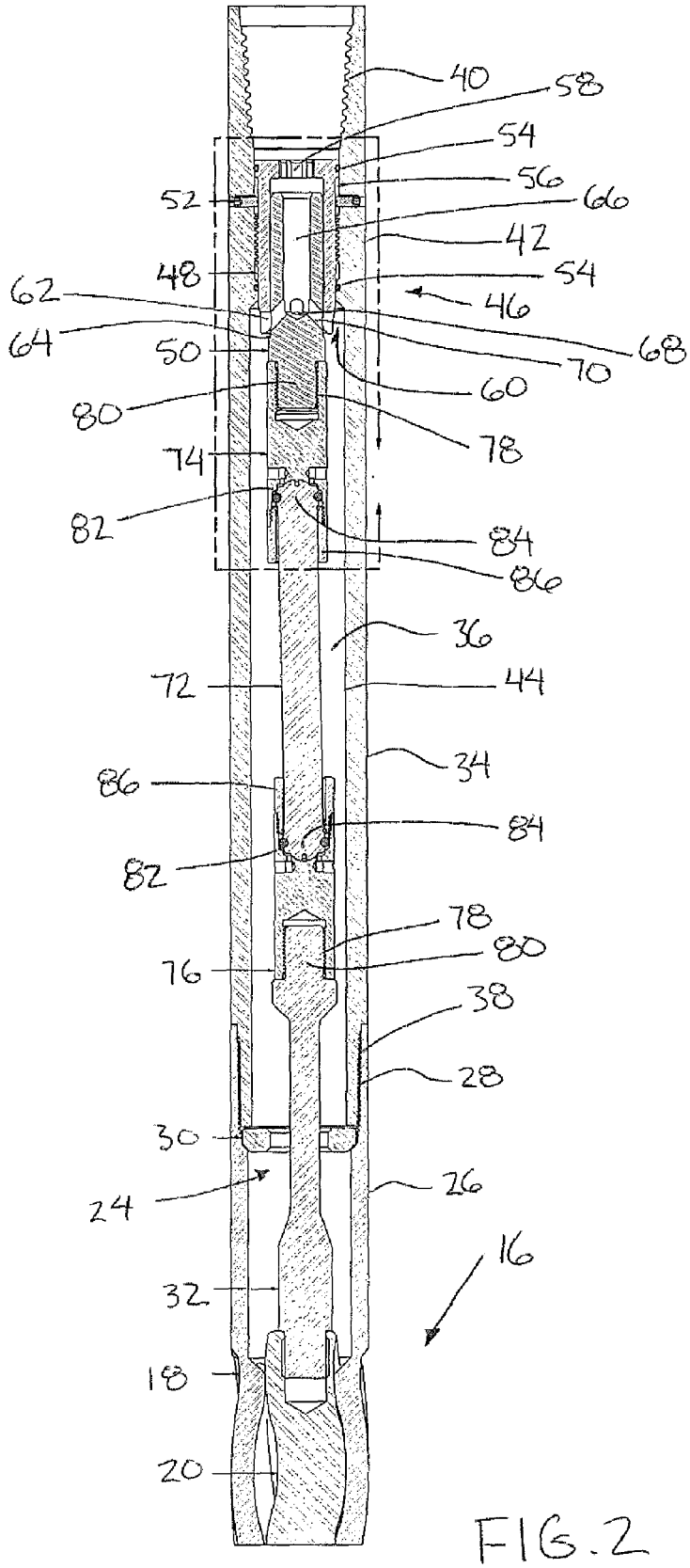
FIG. 2 is a sectional elevational view of the downhole flow pulsing device in the drill string of FIG. 1.

Referring to the accompanying figures there is illustrated a flow pulsing device generally indicated by reference numeral 10. The device 10 is particularly suited for use with a drill string 12 of the type connected to the bottom end of a tubing string 14 in a well bore being formed.

The drill string comprises a drill motor 16 coupled to the bottom end of the tubing string which further comprises a stator housing 18 connected in series to the tubing string 14 and a rotor 20 rotatably received within the stator housing. The stator housing and the rotor have complimentary lobes to force to rotation of the rotor 20 relative to the stator housing responsive to a flow of drilling fluid pumped into the drill motor from the tubing string 14. The drill motor 16 thus comprises a progressive cavity positive displacement motor which rotates a drill bit 22 of the drill string which is coupled to rotate with the rotor 20 at the bottom end thereof. Suitable rotor bearings are provided in the drill motor to fix the position of the rotor relative to the stator in the longitudinal direction.

In operation the drilling fluid is pumped downwardly through the tubing string into the top end of the stator housing such that the configuration of the lobes of the stator housing and rotor results in rotation of the rotor. The configuration of the lobes results in a prescribed number of fluid pressure fluctuations in the drilling fluid pumped through the stator housing for each full rotation of the rotor relative to the housing. The configuration of the rotor within the housing results in an eccentric rotation of the top end of the rotor about an upright longitudinal axis of the housing.

In the illustrated embodiment, a rotor keeper 24 is provided for connection between the top end of the drill motor and the tubing string. The rotor keeper 24 is received in an upper portion 26 of the stator housing comprising a tubular extension extending in the longitudinal direction upwardly beyond the end of the rotor 20 and the lobes within the stator housing 18. The upper portion 26 includes a female connecting portion at the top end thereof. The connecting portion 28 generally comprises a counter bore in the end of the tubular upper portion of increased internal diameter which is internally threaded and terminates at an internal shoulder against which the bottom end of the remainder of the tubing string thereabove is connected.

The rotor keeper 24 generally comprises an annular retainer member 30 which is annular in shape and which is similar in outer diameter to the counter bore forming the connecting portion 28 at the end of the upper portion so that the retainer member 30 can be received within the connecting portion 28 in abutment with the shoulder at the inner end thereof. An internal diameter of a central opening in the retainer member 30 is smaller than the internal diameter of the upper portion of the stator housing and the tubing string thereabove.

The rotor keeper 24 further comprises a keeper member 32 in the form of an elongate shaft which is only slightly longer than the upper portion of the stator housing projecting upwardly beyond the rotor. The keeper member 32 is mounted in fixed connection to the top end of the rotor 20 at the bottom end thereof such that the rotor and the keeper member are eccentrically rotated together about the longitudinal axis of the stator housing. The diameter of the shaft forming the keeper member is smaller than the diameter of the central opening in the retainer member through which it is received to allow the eccentric rotation of the shaft relative to the surrounding retainer member. The top end of the keeper member is enlarged in diameter in a lateral dimension relative to the central portion of the keeper member which extends through the retainer member 30 such that the top end of the keeper member is larger in diameter than the interior diameter of the central opening in the retainer member 30 to prevent passage of the top end of the keeper member downwardly through the retainer member 30. In this instance, in the result of any failure of the rotor relative to the stator housing, the rotor is prevented from falling downwardly through the stator housing by the top end being retained by the rotor keeper relative to the top end of the stator housing.

The device 10 generally comprises a tubular housing 34 arranged to be connected in series between the tubing string 14 thereabove and the drill string 12 therebelow. The tubular housing 34 is generally cylindrical and elongate in a direction of a longitudinal axis of the tubing string. An axial bore 36 extends in the direction of a longitudinal axis of the housing from the top end to the bottom end through the housing. The bottom end 38 of the housing includes a male connecting portion arranged to be threadably received into the female connecting portion at the top end of the stator housing. The opposing top end 40 includes a connecting portion in the form of a female connector having an internally threaded counter bore for threaded connection to the bottom end of the tubing string thereabove.

The tubular housing 34 between the threaded top and bottom ends is divided into an upper portion 42 adjacent the top end and a lower portion 44 which spans the majority of the length of the housing below the upper portion. The lower portion has a cylindrical constant diameter inner surface which is greater in diameter than the upper portion 42 thereabove. The upper portion 42 adjacent the connecting portion at the top end is reduced in internal diameter as compared to the connecting portion thereabove and as compared to the lower portion 44 therebelow. A central portion of the upper portion 42 is internally threaded for mounting the flow pulsing valve 46 of the device therein.

The flow pulsing valve 46 comprises a fixed portion 48 threadably mounted into the threaded portion of the upper portion 42 of the housing so as to be substantially fixed in orientation relative to the tubular housing in operation. The valve 46 further comprises a rotating portion 50 which is rotatably supported within the fixed portion 48 for rotation about a longitudinal axis of the tubular housing relative to the fixed portion as well as being supported for longitudinal sliding movement relative to the fixed portion in the direction of the longitudinal axis.

The fixed portion 48 comprises a collar having a generally cylindrical body with an outer diameter which fits within the upper portion 42 of the axial bore through the housing 34. External threads on the fixed portion 48 permit the threaded connection between the fixed portion 48 of the valve and the surrounding upper portion of the housing 34. Due to the threaded connection therebetween, rotation of the fixed portion 48 about the longitudinal axis of the housing in relation to the housing controls the position of the fixed portion 48 in the direction of the longitudinal axis relative to the housing.

A plurality of set screws 52 are received within respective mounting apertures through the cylindrical wall of the housing 34 for frictional engagement with the peripheral wall of the fixed portion 48 when the set screws are tightened to retain the axial position of the fixed portion 48 at any one of a plurality of different positions in the longitudinal direction relative to the tubular housing corresponding to different operating positions of the flow pulsing valve 46.

An upper end of the collar forming the fixed portion 48 includes a flange portion having a radial dimension similar to the threads therebelow for mounting a suitable O-ring annular sealing member in an annular groove therein which provides sealing engagement between the outer surface of the fixed portion 48 of the valve and the surrounding inner surface of the axial bore of the tubular housing. Adjacent a bottom end of the upper portion 42 of the housing there is provided an annular formation with an annular groove therein for locating an O-ring annular sealing member therein which is engaged between the outer surface of the fixed portion 48 of the valve and the surrounding inner surface of the tubular housing 34 below the threaded connection therebetween. Accordingly there is provided one of the O-rings 54 in engagement between the fixed potion 48 of the valve and the surrounding tubular housing at locations both above and below the threaded connection therebetween. Any flow of drilling fluid is thus directed through a valve bore 56 extending axially through the body forming the fixed portion 48 of the valve.

The valve bore 56 is open through the top end through a suitable central opening in the top of the body forming the fixed portion 48 such that fluid pumped down through the tubing string is communicated into the valve bore 56 through the top opening 58. The top opening 58 is non-circular in cross section for mating with a suitable tool to selectively drive rotation of the fixed portion 48 relative to the surrounding tubular housing 34 when varying the operating position of the valve.

The bottom end of the fixed portion 48 protrudes downwardly beyond the upper portion 42 of the surrounding housing into the lower portion 44 of increased internal diameter so as to define an annular space 60 about the bottom end of the body forming the fixed portion 48 of the valve between the fixed portion and the surrounding inner surface of the lower portion 44 of the housing 34.

The body forming the fixed portion 48 of the valve further comprises a plurality of fixed ports 62 which are provided at circumferentially spaced positions about the longitudinal axis in which each fixed port extends radially outward for communication between the valve bore 56 and the surrounding annular space 60. Each of the fixed ports is also open through to the bottom end of the body forming the fixed portion 48.

The body forming the fixed portion 48 also includes a bypass channel 64 formed adjacent the bottom end along the inner surface of the valve bore 56. More particularly the bypass channel 64 comprises an annular groove open to the inner surface of the valve bore and to the bottom end of the body forming the fixed portion 48 of the valve. The bypass channel 64 is thus located to be connected in the circumferential direction between all of the fixed ports 62. The dimension of the bypass channel 64 is such that the channel is much shorter in length in the direction of the longitudinal axis than the fixed ports in communication therewith thereabove, such that an overall area of the bypass channel 64 in communication with the valve bore is much smaller than the communication of the area of the fixed ports with the valve bore.

The rotating portion 50 of the valve 46 similarly comprises a generally cylindrical body in the form of a sleeve which is mounted in the valve bore so that the outer diameter of the rotating portion 50 is close in dimension to the inner diameter of the valve bore. The rotating portion 50 is supported within the surrounding fixed portion 48 such that the rotating portion is both slidable in the longitudinal direction of the longitudinal axis of the housing as well as being rotatable about the longitudinal axis in relation to the fixed portion 48.

The rotating portion includes a central bore 66 extending axially therethrough from an open top end receiving fluid from the central opening 58 in the top of the fixed portion. The internal diameter of the central bore 56 is near in dimension to the internal diameter of the top opening 58 in the fixed portion. The bottom end of the central bore 56 terminates at a bottom wall 68 where the flow of drilling fluid is diverted generally radially outward from the central bore 66 through respective rotating ports 70 near in elevation to the fixed ports 62 in the surrounding fixed portion 48. The number of rotating ports 70 is identical to the number of fixed ports with both sets of ports being spaced evenly in the circumferential direction about the longitudinal axis. The rotating ports 70 are sloped downwardly and radially outward from the central bore to respective outer ends which are arranged to communicate with the bypass channel 64 and the fixed ports 62 respectively.

Under normal operation, the height of the outlet side of the rotating ports 70 is set to typically overlap both the elevation of the fixed ports and the elevation of the bypass channel therebelow. Fluid diverted downwardly through the valve from the tubing string is thus directed through the central bore 66 to the rotating ports to be subsequently directed in a constant manner to the bypass channel overlapping the bottom portion of the rotating ports. Simultaneously, rotation of the rotating portion relative to the fixed portion causes the upper portions of the rotating ports to be aligned with the fixed ports only at regular intervals so that the communication is intermittent through the ports. In this manner a small portion of fluid is permitted to continuously flow from the rotating ports to the bypass channel while the larger portion of the flow is directed intermittently through the fixed ports to produce surges in the pressure of drilling fluid downstream from the valve when the valve is rotated in operation.

The rotating portion of the valve is typically fixed in the longitudinal direction of the longitudinal axis relative to the surrounding tubular housing by connection of the rotating portion of the valve to the rotor of the drilling motor as described in further detail below. Accordingly by adjusting the position of the fixed portion of the housing in the longitudinal direction of the longitudinal axis, the ratio of the portion of the rotating ports which overlap the fixed ports intermittently in communication therewith versus the amount of overlap of the rotating ports with the bypass channel in communication therewith is adjusted.

Figure 3:
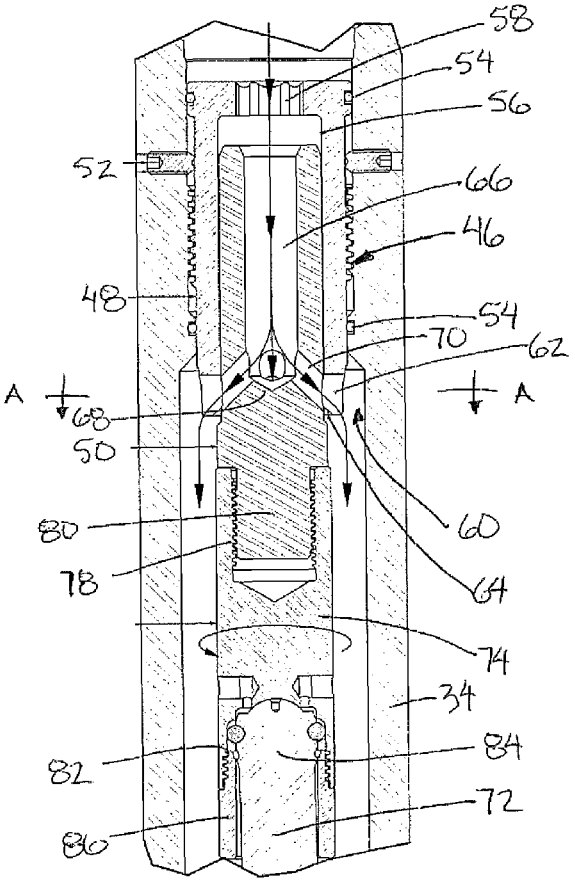
FIG. 3 is an enlarged sectional view of the valve of the flow pulsing device in an open position of the valve.
Figure 4:
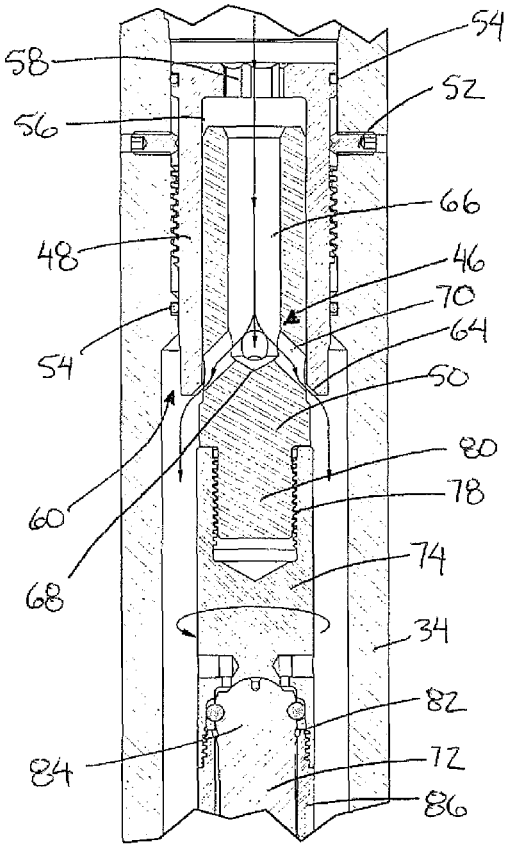
FIG. 4 is a cross sectional view of the valve similar to FIG. 3, but in a closed position of the valve.
Figure 5:
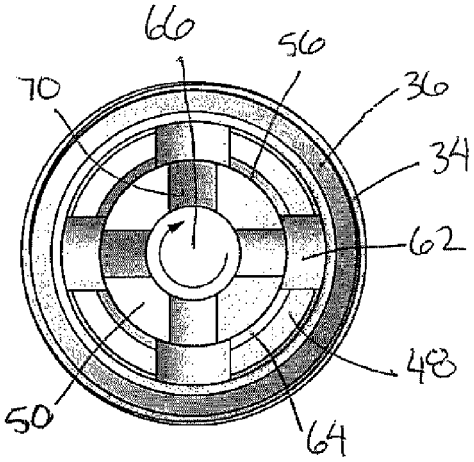
FIG. 5 and FIG. 6 are sectional views along the line A-A of FIG. 3 in the open and closed positions of the valve respectively.
Figure 6:
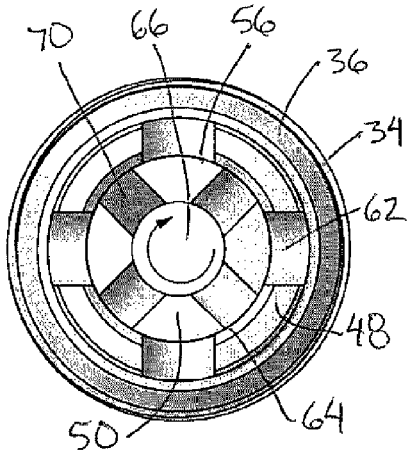

The longitudinal positioning of the fixed portion thus has an effect on the maximum communication area of the rotating ports with the fixed ports at the portion of rotation where they are fully in alignment with one another. Rotation of the rotating portion of the valve relative to the surrounding fixed portion causes the flow area through the valve to be varied from the maximum communication when the ports are in alignment with one another in the open position of FIGS. 3, 5 and 7 to a minimum communication area corresponding to only communication of fluid through the bypass channel when the ports are in not aligned with one another in a closed position shown in FIGS. 4, 6 and 8. The flow passage area through the valve thus corresponds to the area of communication between the central bore in the rotating portion of the valve and the surrounding annular space in the tubular housing between the valve and the surrounding lower portion of the tubular housing spaced outwardly therefrom.

When adjusting the fixed portion between different set positions thereof relative to the surrounding tubular housing, the result of adjusting the maximum communication area between the rotating ports and the fixed ports as well as the bypass area of communication between the rotating ports and the bypass channel, is that the resulting amplitude of the fluid pulses downstream from the valve is adjusted. Rotation of the fixed portion of the housing relative to the tubular housing causes its longitudinal position to be adjusted for simultaneously adjusting the maximum communication area between the ports and the communication with the bypass area.

The rotating portion of the valve is coupled to the rotor of the drill motor therebelow by a drive link member 72 which comprises an elongate shaft extending generally in the direction of the longitudinal axis. The upper end of the drive link member is coupled by an upper universal joint 74 directly to the body of the rotating portion of the valve while a lower universal joint 76 couples the bottom end of the drive link member to the top end of the rotor keeper member 32.

Each of the universal joints 74 and 76 comprises an elongate body having a threaded socket 78 at an outer end thereof comprising a female connection for threaded connection to a correspond male connector 80 on the bottom end of the rotating portion of the valve or on the top end of the shaft of the rotor keeper member 32 respectively. The opposing inner end of each universal joint includes a suitable socket 82 at the inner which receives a respective one of the ends of the shaft of the drive link member therein.

The ends of the shaft as well as the sockets 82 have a suitable mating cross section which is either splined or polygonal for example so that the shafts and the bodies forming the universal joints above and below the shaft are all arranged to rotate together; however, the ends of the shaft are rounded in profile to allow so side to side rocking motion of the shaft relative to each of the bodies forming the universal joints 74 and 76. The rounded profile at the ends of the shaft correspond to an end portion 84 of enlarged dimension received within the socket 82 and retained therein by a suitable retainer 86 which is annular about the shaft. The retainer 86 has an inner diameter which is smaller than the internal diameter of the enlarged ends of the shaft such that threading the retainer into the respective socket 82 permits the enlarged ends of the shaft to be retained in the axial direction within the respective bodies forming the universal joints.

The connections of the universal joints are such that the position of the rotating portion of the valve in the longitudinal direction is fixed by the drive link member 72 to the rotor of the drill motor which is in turn fixed relative to the surrounding housing thereof by suitable bearings of the drill motor coupled between the rotor and surrounding stator housing. The universal joints permit the body of the lower universal joint 76 to follow the eccentric rotation of the rotor keeper and drill motor rotor to which it is coupled while the body of the upper universal joint rotates concentrically with the longitudinal axis of the rotating portion of the valve thereabove. The drive link member 72 thus translates the rotation of the rotor to rotation of the rotating portion of the valve relative to the surrounding housing despite the rotor rotating eccentrically relative to the longitudinal axis and the rotating portion of the valve rotating concentrically about the longitudinal axis.

As shown in FIGS. 1 through 6, according to a first embodiment for four rotating ports are provided at equally spaced positions in the circumferential direction for communication with four similarly equally circumferentially spaced ports in the fixed portion of the valve. By arranging the number of ports in the valve to specifically not match the natural frequency of the drill motor to which it is coupled, the amplitude of fluid pressure pulses downstream of the valve and the resulting amplitude of vibration of the drill string can be maximized. Specifically the number of ports is selected to be mismatched with the prescribed number of fluid pressure fluctuations per full rotation of the drill rotor relative to the stator housing. The embodiment of FIGS. 1 through 6 is thus well suited for a drill motor having lobes on the rotor and stator housing which naturally produce 3, 5 or 6 or any multiple thereof, of fluid pressure fluctuations per rotation of the motor.

Figure 7:
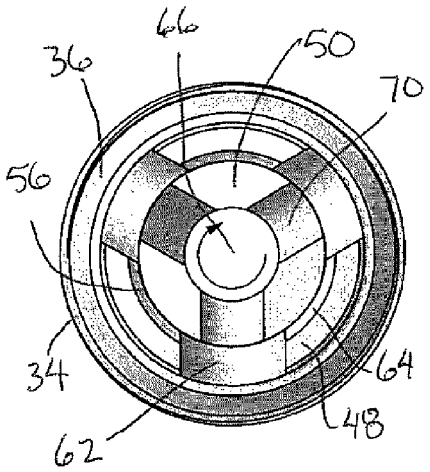
FIG. 7 and FIG. 8 are cross sectional views along the line A-A of FIG. 3 according to an alternative embodiment of the flow pulsing device in the open position and closed position respectively.
Figure 8:
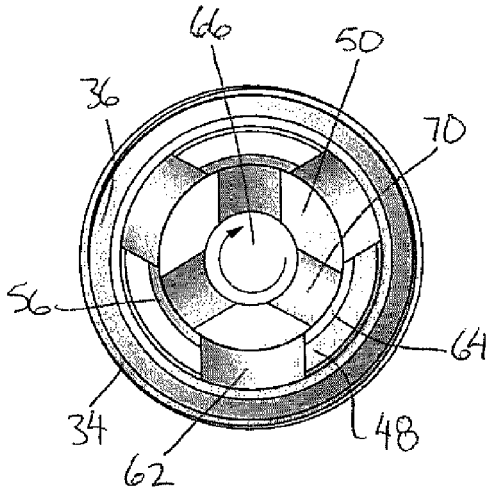

According to a further embodiment of FIGS. 7 and 8, the number of fixed ports and rotating ports are both 3 which are again equally circumferentially spaced about the longitudinal axis. A valve of this configuration is particularly well suited for a drill motor having lobes configured to produce 2, 4, or 5 pressure fluctuations per rotation or any multiple thereof. In each instance the number ports is not evenly divisible into the prescribed number of pressure fluctuations per rotation of the motor nor is the prescribed number of pressure fluctuations per rotation of the motor evenly divisible into the number or ports.

In operation, the flow pulsing valve is typically mounted in the tubing string above the drill motor in sufficiently close proximity to permit the rotating portion of the valve to be readily connected directly to the existing rotor of the drill motor rather than employing any other additional motor to drive the rotation of the valve. By varying the number of ports when selecting a flow pulsing device for a particular drill motor, the user can maximize the vibrations produced in a reliable and consistent manner as the rotation of the flow pulsing valve is always matched to be out of synchronicity to the rotation of the rotor of the drill motor. By further providing an adjustment in the longitudinal direction of the alignment of fixed and rotating ports oriented in a radial direction, the ratio of fluid which is forced into intermittent communication with the fixed ports versus constant communication with the bypass channel permits a ready adjustment of the amplitude of the vibrations produced in a manner which can be readily adjusted in the field. Adjustment requires merely loosening the set screws and varying the threaded connection between the fixed portion of the valve and the surrounding tubular housing. The direct connection of the rotating component of the valve with the rotor of the drilling motor which is constrained in the longitudinal direction by suitable bearings further ensures that the components of the valve cannot be misaligned from their set position by a simple back pressure or back flow of drilling fluid up the tubing string as can occur in some prior art devices.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A downhole flow pulsing device in combination with a drill string comprising a tubing string, a drilling motor having a stator housing connected in series with the tubing string and a rotor supported in the stator housing so as to be arranged to rotate relative to the stator housing and tubing string responsive to a flow of pressurized drilling fluid into the tubing string, a drill bit coupled to a bottom end of the rotor of the drilling motor so as to be arranged to rotate with the rotor of the drilling motor, and a rotor keeper, the downhole flow pulsing device comprising:

a tubular housing arranged to be connected in series with the tubing string, the housing having an axial bore extending along a longitudinal axis therethrough so as to be arranged to permit passage of the drilling fluid therethrough;

a valve supported in the bore of the tubular housing and defining a flow passage arranged to receive the drilling fluid therethrough, the valve comprising a fixed portion in fixed relation to the tubular housing and a rotating portion rotatably supported in the tubular housing so as to vary an area of the flow passage as the rotating portion rotates relative to the fixed portion;

a drive link member arranged to be connected between the rotating portion of the valve and the rotor of the drilling motor so as to rotate the rotating portion of the valve relative to the tubing string together with the rotor of the drilling motor;

wherein the rotor keeper comprises an annular retainer member mounted in series with the tubing string between the stator housing of the drilling motor and the tubular housing of the flow pulsing device and a keeper member extending through the retainer member so as to be connected in series between the rotor of the drilling motor and the drive link member, the keeper member including a portion of enlarged dimension above the retainer member which cannot pass through the annular retainer member.

2. The device according to claim 1 wherein the rotating portion of the valve is coupled to the rotor of the drilling motor by the drive link member such that only the drilling motor drives rotation of the rotating portion of the valve relative to the fixed portion of the valve.

3. The device according to claim 1 wherein the rotor is rotated eccentrically within the stator housing and wherein the drive link member comprises a lower universal joint arranged for coupling a bottom end of the drive link member to the rotor and an upper universal joint arranged for coupling a top end of the drive link member to the rotating portion of the valve.

4. The device according to claim 1 wherein the rotating portion is supported in an axially extending valve bore in the fixed portion so as to be rotatable about the longitudinal axis relative to the fixed portion, the fixed portion comprising a plurality of fixed ports at circumferentially spaced positions for communication between the valve bore and an annular space in the tubular housing about the drive link member therebelow and the rotating portion comprising a central bore having a top end arranged to receive drilling fluid from the tubing string and a plurality of rotating ports at circumferentially spaced positions extending radially outward from the central bore so as to be arranged to intermittently communicate with the fixed ports as the rotating portion of the valve is rotated.

5. The device accordingly to claim 4 wherein there is provided an equal number of fixed ports and rotating ports.

6. The device according to claim 1 wherein the drill motor generates a prescribed number of pressure fluctuations in the drilling fluid for each full rotation of the rotor within the stator housing and wherein the rotating portion comprises a plurality of rotating ports and the fixed portion comprises a plurality of fixed ports arranged to intermittently communicate with the rotating ports as the rotating portion is rotated relative to the fixed portion, the number of rotating ports and said prescribed number being different from one another such that the number of rotating ports is not evenly divisible into said prescribed number and said prescribed number is not evenly divisible into the number of rotating ports.

7. A downhole flow pulsing device for use with a drill string comprising a tubing string, a drilling motor having a stator housing connected in series with the tubing string and a rotor supported in the stator housing so as to be arranged to rotate relative to the stator housing and tubing string responsive to a flow of pressurized drilling fluid into the tubing string, and a drill bit coupled to a bottom end of the rotor of the drilling motor so as to be arranged to rotate with the rotor of the drilling motor, the downhole flow pulsing device comprising:

a tubular housing arranged to be connected in series with the tubing string, the housing having an axial bore extending along a longitudinal axis therethrough so as to be arranged to permit passage of the drilling fluid therethrough;

a valve supported in the bore of the tubular housing and defining a flow passage arranged to receive the drilling fluid therethrough, the valve comprising a fixed portion in fixed relation to the tubular housing and a rotating portion rotatably supported in the tubular housing so as to vary an area of the flow passage as the rotating portion rotates relative to the fixed portion; and a drive link member arranged to be connected between the rotating portion of the valve and the rotor of the drilling motor so as to rotate the rotating portion of the valve relative to the tubing string together with the rotor of the drilling motor;

wherein the rotating portion comprises a plurality of rotating ports and the fixed portion comprises a plurality of fixed ports arranged to intermittently communicate with the rotating ports as the rotating portion is rotated relative to the fixed portion and wherein the fixed portion is adjustable in position in a direction of the longitudinal axis relative to the rotating portion so as to vary a maximum communication area between the fixed and rotating ports.

8. The device according to claim 7 in combination with the drill string wherein the rotor is fixed in a longitudinal direction relative to the stator housing by rotor bearings and wherein the rotating portion is substantially fixed in the direction of the longitudinal axis relative to the tubular housing by the drive link member connected between the rotating portion and the rotor of the drilling motor.

9. A downhole flow pulsing device for use with a drill string comprising a tubing string, a drilling motor having a stator housing connected in series with the tubing string and a rotor supported in the stator housing so as to be arranged to rotate relative to the stator housing and tubing string responsive to a flow of pressurized drilling fluid into the tubing string, and a drill bit coupled to a bottom end of the rotor of the drilling motor so as to be arranged to rotate with the rotor of the drilling motor, the downhole flow pulsing device comprising:

a tubular housing arranged to be connected in series with the tubing string, the housing having an axial bore extending along a longitudinal axis therethrough so as to be arranged to permit passage of the drilling fluid therethrough;

a valve supported in the bore of the tubular housing and defining a flow passage arranged to receive the drilling fluid therethrough, the valve comprising a fixed portion in fixed relation to the tubular housing and a rotating portion rotatably supported in the tubular housing so as to vary an area of the flow passage as the rotating portion rotates relative to the fixed portion; and a drive link member arranged to be connected between the rotating portion of the valve and the rotor of the drilling motor so as to rotate the rotating portion of the valve relative to the tubing string together with the rotor of the drilling motor;

wherein the rotating portion is supported in an axially extending valve bore in the fixed portion so as to be rotatable about the longitudinal axis relative to the fixed portion;

the fixed portion comprising a plurality of fixed ports at circumferentially spaced positions for communication between the valve bore and an annular space in the tubular housing about the drive link member therebelow;

the rotating portion comprising a central bore having a top end arranged to receive drilling fluid from the tubing string and a plurality of rotating ports at circumferentially spaced positions extending radially outward from the central bore so as to be arranged to intermittently communicate with the fixed ports as the rotating portion of the valve is rotated; and the rotating portion being positioned relative to the fixed portion to define a bypass area which remains in communication between the central bore of the rotating portion and the annular space in the tubular housing below the valve as the rotating ports intermittently communicate with the fixed ports to define the variable flow passage.

10. The device according to claim 9 wherein the bypass area and a maximum communication area between the fixed and rotating ports are adjustable simultaneously with one another.

11. The device according to claim 9 wherein the bypass area is adjustable by displacing the fixed portion relative to the rotating portion in a direction of the longitudinal axis.

12. The device according to claim 11 wherein the fixed portion is movable in the direction of the longitudinal axis relative to the tubular housing between a plurality of different set positions corresponding to different bypass areas.

13. The device according to claim 12 wherein the fixed portion of the valve is threadably received in the tubular housing such that a position of the fixed portion in the direction of the longitudinal axis is adjusted by rotating the fixed portion relative to the tubular housing about the longitudinal axis.

14. The device according to claim 12 wherein there is provided a set screw arranged to retain the fixed portion in fixed relation to the tubular housing in each of the set positions.

15. A downhole flow pulsing device for use with a drill string comprising a tubing string, a drilling motor having a stator housing connected in series with the tubing string and a rotor supported in the stator housing so as to be arranged to rotate relative to the stator housing and tubing string responsive to a flow of pressurized drilling fluid into the tubing string, and a drill bit coupled to a bottom end of the rotor of the drilling motor so as to be arranged to rotate with the rotor of the drilling motor, the downhole flow pulsing device comprising:

a tubular housing arranged to be connected in series with the tubing string, the housing having an axial bore extending along a longitudinal axis therethrough so as to be arranged to permit passage of the drilling fluid therethrough;

a valve supported in the bore of the tubular housing and defining a flow passage arranged to receive the drilling fluid therethrough, the valve comprising a fixed portion in fixed relation to the tubular housing and a rotating portion rotatable supported in the tubular housing so as to vary an area of the flow passage as the rotating portion rotates relative to the fixed portion; and a drive link member arranged to be connected between the rotating portion of the valve and the rotor of the drilling motor so as to rotate the rotating portion of the valve relative to the tubing string together with the rotor of the drilling motor;

wherein the rotating portion is supported in an axially extending valve bore in the fixed portion so as to be rotatable about the longitudinal axis relative to the fixed portion;

the fixed portion comprising:

a plurality of fixed ports at circumferentially spaced positions for communication between the valve bore and an annular space in the tubular housing about the drive link member therebelow; and a bypass channel extending about a full circumference of the valve bore below the fixed ports and in communication with said annular space; and the rotating portion comprising a central bore having a top end arranged to receive drilling fluid from the tubing string and a plurality of rotating ports at circumferentially spaced positions extending radially outward from the central bore so as to be arranged both to intermittently communicate with the fixed ports as the rotating portion of the valve is rotated and to communicate with the bypass channel therebelow.

16. The device according to claim 15 wherein a ratio between communication of the rotating ports with the bypass channel and communication of the rotating ports with the fixed ports is adjustable by displacing the fixed portion relative to the rotating portion in a direction of the longitudinal axis.

17. A downhole flow pulsing device for use with a tubing string arranged to receive a flow of pressurized drilling fluid therethrough, the device comprising:

a tubular housing arranged to be connected in series with the tubing string, the housing having an axial bore extending along a longitudinal axis therethrough so as to be arranged to permit passage of the drilling fluid therethrough;

a valve supported in the bore of the tubular housing and defining a flow passage arranged to receive the drilling fluid therethrough, the valve comprising a fixed portion in fixed relation to the tubular housing and a rotating portion rotatably supported in the tubular housing so as to vary an area of the flow passage as the rotating portion rotates relative to the fixed portion;

a fluid actuated positive displacement motor arranged to drive rotation of the rotating portion of the valve responsive to the flow of pressurized drilling fluid in the tubing string;

the rotating portion of the valve being supported in an axially extending valve bore in the fixed portion so as to be rotatable about the longitudinal axis relative to the fixed portion;

the fixed portion comprising a plurality of fixed ports at circumferentially spaced positions for communication between the valve bore and an annular space in the tubular housing about the drive link member therebelow;

the rotating portion comprising a central bore having a top end arranged to receive drilling fluid from the tubing string and a plurality of rotating ports at circumferentially spaced positions extending radially outward from the central bore so as to be arranged to intermittently communicate with the fixed ports as the rotating portion of the valve is rotated;

the rotating portion being positioned relative to the fixed portion to define a bypass area which remains in communication between the central bore of the rotating portion and the annular space in the tubular housing below the valve as the rotating ports intermittently communicate with the fixed ports; and the bypass area being adjustable by displacing the fixed portion relative to the rotating portion in a direction of the longitudinal axis.

18. The device according to claim 17 wherein a position of the rotation portion is fixed in the direction of the longitudinal axis relative to the tubular housing by suitable bearings and wherein the fixed portion is movable in the direction of the longitudinal axis relative to the tubular housing between a plurality of different set positions corresponding to different bypass areas.

* * * * *